US005161720A

United States Patent [19]

Kolton et al.

[11] Patent Number: 5,161,720

[45] Date of Patent: Nov. 10, 1992

[54] GARMENT HANGER FOR THIN ARTICLES

[75] Inventors: Chester Kolton, Westfield; Stuart S. Spater, Livingston, both of N.J.

[73] Assignee: B&G Plastics, Inc., Newark, N.J.

[21] Appl. No.: 684,299

[22] Filed: Apr. 12, 1991

[51] Int. Cl.[5] ..... A47G 25/14; A47G 25/74

[52] U.S. Cl. ..... 223/85; 223/87; 223/DIG. 1; D6/327

[58] Field of Search ..... 223/85, 88, 87, DIG. 1, 223/DIG. 2, DIG. 3; 24/564, 567; D6/315, 327, 322, 323, 326

[56] References Cited

U.S. PATENT DOCUMENTS

| | | | |
|---|---|---|---|
| D. 186,004 | 8/1959 | Coon | D6/315 |
| D. 195,017 | 4/1963 | Wilhelm | D6/315 |
| D. 264,789 | 6/1982 | Zyla et al. | D6/315 |
| 2,191,714 | 2/1940 | Gustin | 223/85 X |
| 2,300,797 | 11/1942 | McOsker | 223/96 |
| 2,634,031 | 4/1953 | Klein | 223/88 |
| 3,186,609 | 6/1965 | Patch | 223/88 |
| 4,148,421 | 4/1979 | Levitt | 223/87 |
| 4,474,316 | 10/1984 | Philibert | 223/DIG. 1 X |
| 4,768,649 | 9/1988 | Kolton | 223/87 X |
| 4,978,043 | 12/1990 | Uke | 223/85 X |

FOREIGN PATENT DOCUMENTS

| | | | |
|---|---|---|---|
| 2157162 | 10/1985 | United Kingdom | 223/DIG. 1 |

*Primary Examiner*—Werner H. Schroeder

*Assistant Examiner*—Bibhu Mohanty

*Attorney, Agent, or Firm*—Robin, Blecker, Daley & Driscoll

[57] ABSTRACT

A garment hanger is comprised of an integral body of synthetic material having a central portion, a hook portion extending outwardly of the central portion, first and second wing portions extending outwardly of the central portion, first and second wing end portions respectively outwardly of the first and second wing portions and third and fourth wing portions extending respectively inwardly of the first and second wing end portions to respective first and second mutually spaced ends of the third and fourth wing portions. The first and third wing portions, the second and third wing portions and the central portion collectively define an opening therebetween. The first and second wing end portions are of asymmetric dimensions transversely of the opening, whereby the third and fourth wing portions have enhanced support against deflection thereof in the plane of the hanger than would otherwise obtain. Otherwise viewed, hangers of the invention have aligned first and second wing portions and the first and second wing end portions support the third and fourth wing portions in an acute angular relation respectively to the first and second wing portions, such that the latter wing portions are not in mutual alignment, but are in intersecting relation.

8 Claims, 3 Drawing Sheets

GARMENT HANGER FOR THIN ARTICLES

FIELD OF THE INVENTION

This invention relates generally to garment hangers and pertains more particularly to hangers for scarfs, sportbands and like garments.

BACKGROUND OF THE INVENTION

Scarf hangers in long commercial existence include types comprised of an integral body of synthetic material having a central portion, a hook portion extending outwardly of the central portion and first and second wing portions extending outwardly of the central portion. First and second wing end portions are at respective outward ends of the first and second wing portions and third and fourth wing portions extend respectively inwardly of the first and second wing end portions to respective first and second mutually spaced ends located at the center of the hanger. The third and fourth wing portions are deflectably supported by the first and second wing end portions to be moved oppositely out of the plane of the hanger, thereby to permit a scarf to be inserted into the open space between the first and third and the second and fourth wing portions and to depend from the third and fourth wing portions.

Applicants have found that such commercial scarf hangers are not adequate to securely provide for the hanging of particularly wide scarfs and like garments, since there is insufficient retention capacity in the known hangers as against the weight of the scarfs of such width. Thus, scarfs dependent from the known hangers can have sufficient weight to overcome the limited retention forces of such hangers.

This disadvantage of prior art scarf hangers applies also to sportband hangers where the sportband, although not of great width, is of sufficient weight to overcome such limited retention capacity.

SUMMARY OF THE INVENTION

The present invention has as its primary object the provision of improved garment hangers.

A more particular object of the invention is to provide improved hanger retention structure for scarfs and like garments of extended width.

A further object of the invention is to provide improved hanger retention structure for sportbands and like garments of extended thickness and weight.

In attaining the foregoing and other objects, the invention provides a garment hanger comprised of an integral body of synthetic material having a central portion, a hook portion extending outwardly of the central portion, first and second wing portions extending outwardly of the central portion, first and second wing end portions respectively outwardly of the first and second wing portions and third and fourth wing portions extending respectively inwardly of the first and second wing end portions to respective first and second mutually spaced ends of the third and fourth wing portions. The first and third wing portions, the second and third wing portions and the central portion collectively define an opening therebetween. The first and second wing end portions are of asymmetric dimensions transversely of the opening, whereby the third and fourth wing portions have enhanced support against deflection thereof in the plane of the hanger than would otherwise obtain.

Otherwise viewed, hangers of the invention have aligned first and second wing portions and the first and second wing end portions support at least parts of the third and fourth wing portions in an acute angular relation respectively to the first and second wing portions, such that the latter wing portions are not in mutual alignment, but are in intersecting relation.

Hangers of the invention additionally may have a projection extending dependently from the central portion into the garment receiving opening. The foregoing and other objects and features of the invention will be further understood from the following detailed description of preferred embodiments thereof and from the drawings wherein like reference numerals identify like parts throughout.

DETAILED DESCRIPTION OF PREFERRED EMBODIMENTS AND PRACTICES

Figure 5:
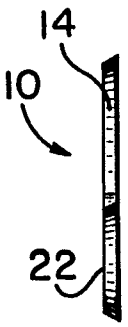
FIG. 5 is a right side elevation of the FIG. 1 hanger.
Figure 2:
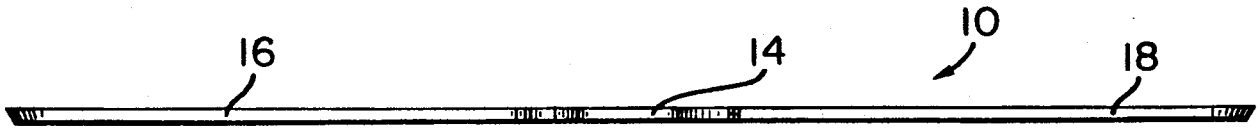
FIG. 2 is a top plan view of the FIG. 1 hanger.

Referring to FIGS. 1–7, hanger 10 is comprised of an integral body of synthetic material having a central portion 12, a hook portion 14 extending outwardly of the central portion, first and second wing portions 16 and 18 extending outwardly of the central portion, first and second wing end portions 20 and 22 respectively outwardly of the first and second wing portions and third and fourth wing portions 24 and 26 extending respectively inwardly of the first and second wing end portions to respective first and second mutually spaced ends 28 and 30 of the third and fourth wing portions. The first and third wing portions, the second and third wing portions and the central portion collectively define an opening 32 therebetween.

As alluded to above, first and second wing end portions 20 and 22 have a configurational asymmetry. Thus, considering the center line of opening 32 to be line 34 (FIG. 6), i.e., a line bisecting first and second wing end portions 20 and 22, it will be seen that the distance D1 upwardly of line 34 to the upper margins 16*a* and 18*a* of first and second wing portions 16 and 18 is less than the distance D2 downwardly of line 34 to the lower margins 24*a* and 26*a* of third and fourth wing portions 24 and 26. Given such wing end portion asymmetry transversely of opening 32, the third and fourth wing portions 24 and 26 have enhanced support against deflection thereof in the plane of the hanger than would otherwise obtain.

Figure 1:
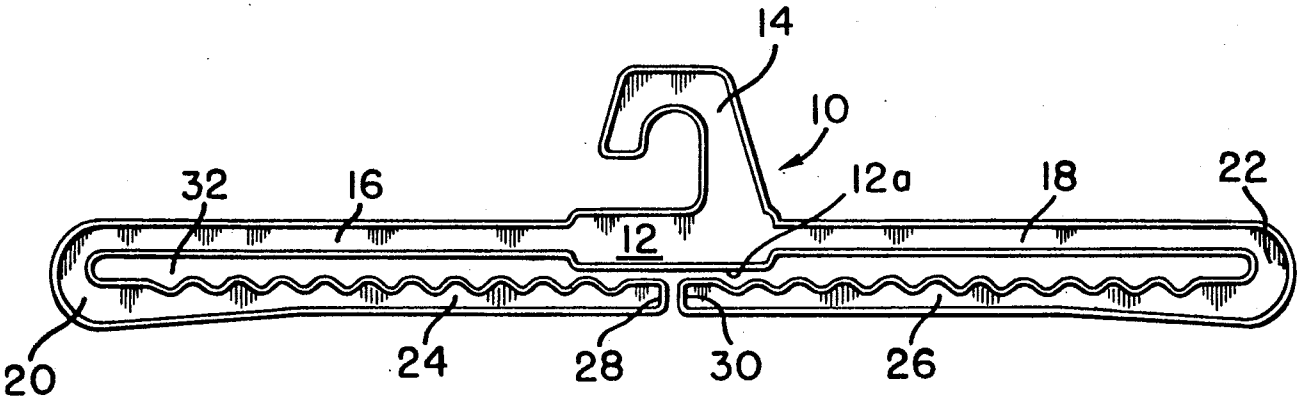
FIG. 1 is a front elevation of a hanger in accordance with the invention.
Figure 3:
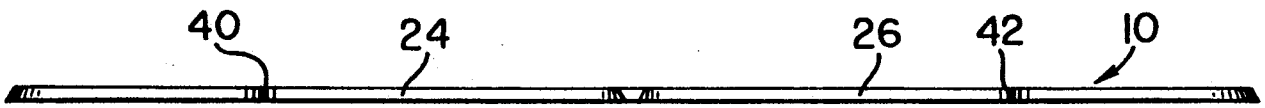
FIG. 3 is a bottom plan view of the FIG. 1 hanger.
Figure 4:
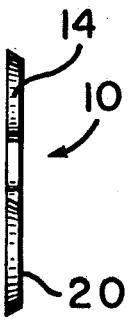
FIG. 4 is a left side elevation of the FIG. 1 hanger.

In use of the hanger, third and fourth wing portions 24 and 26 are displaced respectively inwardly and outwardly of the plane of FIG. 1, or vice versa, and a scarf or the like is inserted beyond ends 28 and 30 into residence in opening 32. The third and fourth wing portions 26 and 26 are then released, returning by self-bias into the plane of the hanger.

Figure 6:
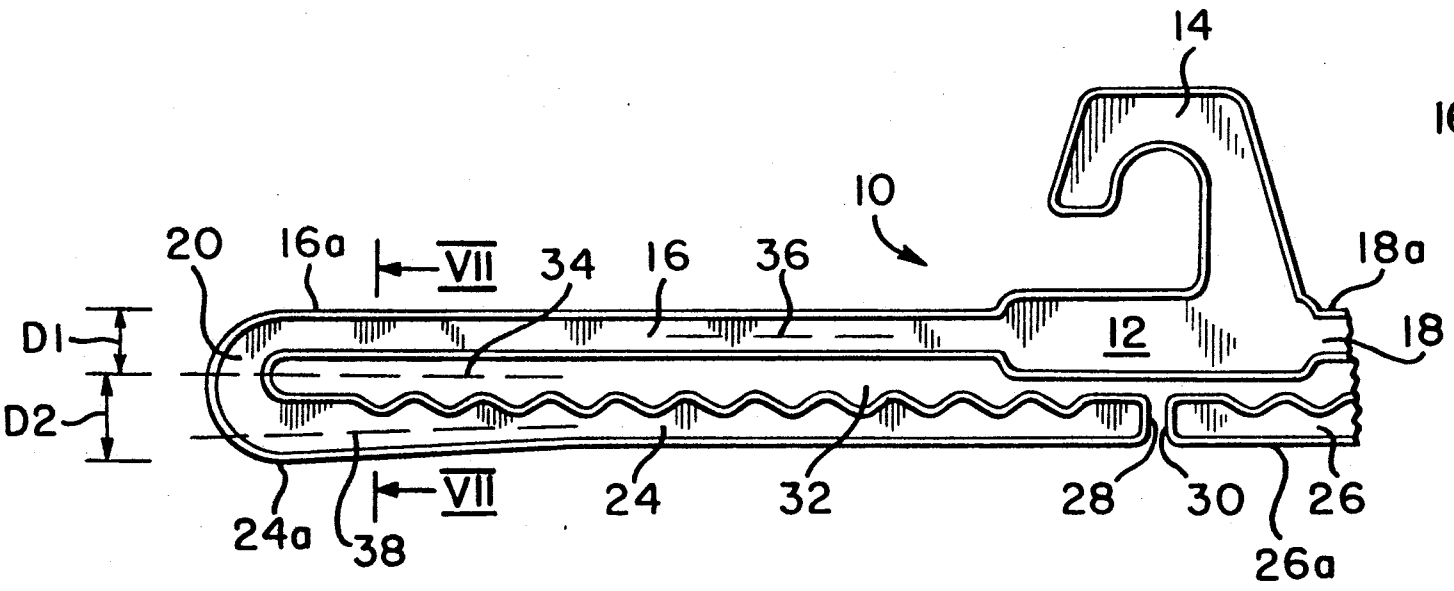
FIG. 6 is an enlarged partial front elevation of the FIG. 1 hanger.

Hangers of the invention are further characterized by a wing portion angulation asymmetry also seen in FIG. 6. Hanger 10 is shown therein in its lefthand and central portions, with the rightward portion largely omitted. First and second wing portions 16 and 18 are aligned as indicated by alignment line 36, which is in parallel relation with centerline 34 of opening 32. On the other hand, centerline 38 of third wing portion 24 is supported by first wing end portion 20 in an acute angular relation to line 36, such that the latter wing portions are not in mutual alignment, but are in intersecting relation.

Figure 7:
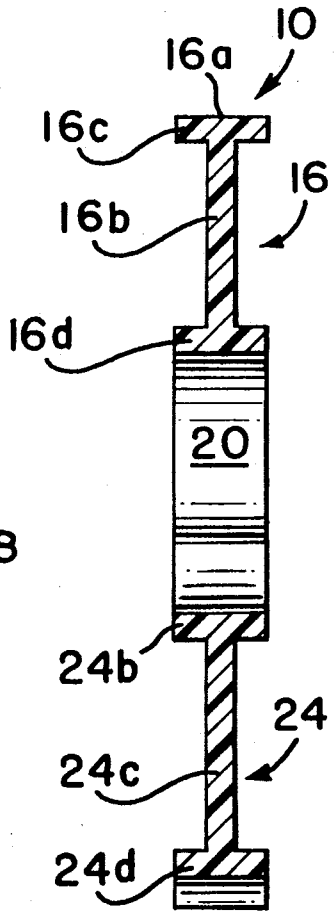
FIG. 7 is a sectional view as seen from plane VII—VII of FIG. 6, further enlarged from FIG. 6.

While the invention contemplates that hanger 10 may comprise a fully planar body, i.e., having front and rear sides which are fully planar, the preferred embodiment shown in FIGS. 1–6 has an I-beam cross-section, as is seen particularly in the sectional view of FIG. 7. Thus, first wing portion 16 has a central planar part 16*b* with flanges 16*c* and 16*d*, the latter encompassing first wing end portion 20 and being continuous with flange 24*b* of third wing portion 24 which further has a central part 24*c* and a flange 24*d*.

The hook portion of hanger 10 may evidently take on configuration other than that illustrated in FIGS. 1–6. Likewise, the undulating configurations of the surfaces of third and fourth wing portions 24 and 26 may be otherwise arranged, e.g., as planar surfaces. Further, while the preferred embodiment looks to only a portion of third and fourth wing portions 24 and 26 as being in intersecting relation with first and second aligned wing portions 16 and 18, i.e., extents thereof progressing from first and second wing end portions 20 and 22 to locations 40 and 42 (FIG. 1), with the remnants of third and fourth wing portions 24 and 26 being parallel with first and second wing portions 16 and 18, the entirety of the extents of third and fourth wing portions 16 and 18 may be disposed in such acute intersecting relation with first and second wing portions 20 and 22.

As is indicated in FIG. 6, the embodiment discussed to this juncture includes a projection 12*a* extending into opening 32 and in registry with the first and second ends 28 and 30 of the third and fourth wing portions. Projection 12*a*, which is cooperative with the third and fourth wing portions for garment retention, is of a thickness equal to that of central portion 12.

Figure 8:
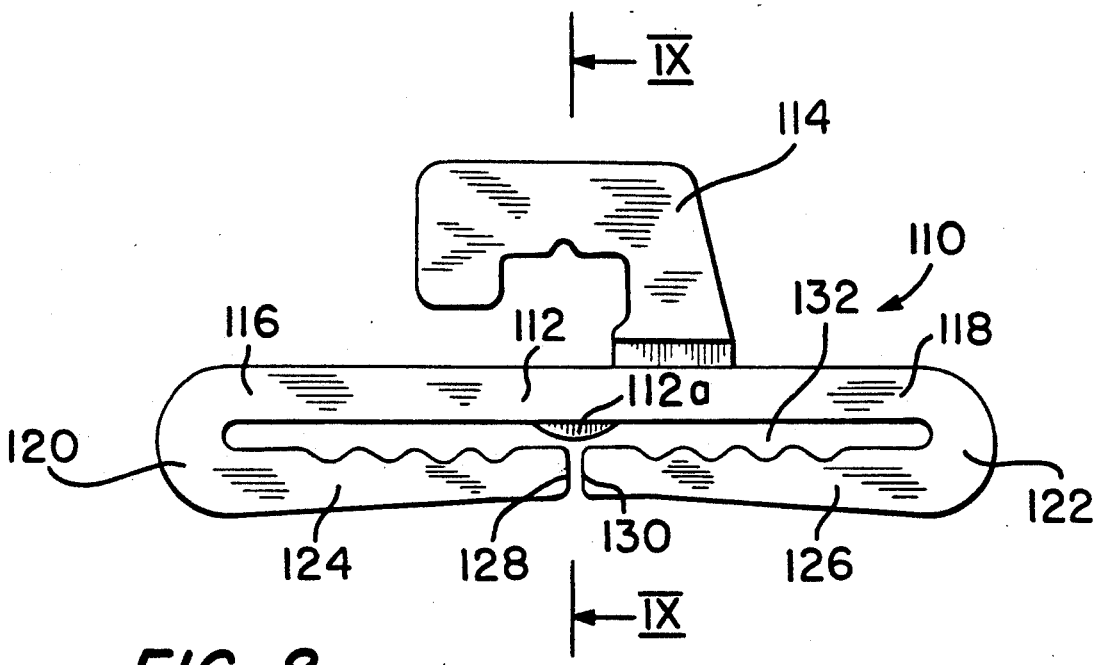
FIG. 8 is a front elevation of a second embodiment of a hanger in accordance with the invention.
Figure 9:
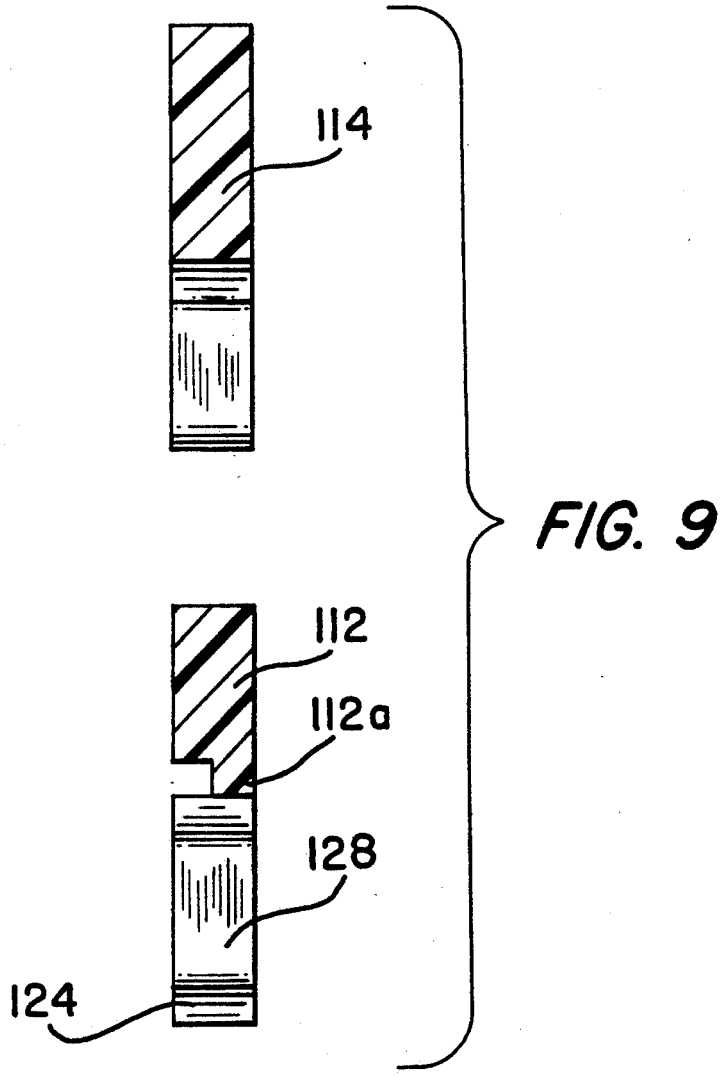
FIG. 9 is a sectional vies as seen from plane IX—IX of FIG. 8, further enlarged from FIG. 8.

Referring now to FIGS. 8 and 9, a second embodiment of a hanger 110, particularly suited for the hanging of sportbands is shown to have substantially lesser horizontal expanse than the hanger of FIGS. 1–7 and is adapted for sportband usage.

Hanger 110 is comprised of an integral body of synthetic material having a central portion 112, a hook portion 114 extending outwardly of the central portion, first and second wing portions 116 and 118 extending outwardly of the central portion, first and second wing end portions 120 and 122 respectively outwardly of the first and second wing portions and third and fourth wing portions 124 and 126 extending respectively inwardly of the first and second wing end portions to respective first and second mutually spaced ends 128 and 130 of the third and fourth wing portions. The first and third wing portions, the second and third wing portions and the central portion collectively define an opening 132 therebetween.

First and second wing end portions 120 and 122 have a configurational asymmetry as above discussed for wing end portions 20 and 22.

As is indicated in FIG. 8, and particularly in FIG. 9, the second embodiment includes a projection 112*a* extending into opening 132 and in registry with the first and second ends 128 and 130 of the third and fourth wing portions. Projection 112*a*, which is cooperative with the third and fourth wing portions, is of a thickness generally equal to one half that of central portion 112.

Various changes in structure to the described hangers and modifications in use thereof may evidently be introduced without departing from the invention. Accordingly, it is to be understood that the particularly disclosed and depicted embodiments are intended in an illustrative and not in a limiting sense. The true spirit and scope of the invention is set forth in the following claims.

We claim:

1. A garment hanger comprised of an integral body of synthetic material having a central portion, a hook portion extending outwardly of the central portion, first and second wing portions extending outwardly of the central portion, first and second wing end portions extending respectively outwardly of the first and second wing portions and third and fourth wing portions extending respectively inwardly of the first and second wing end portions to respective first and second mutually spaced ends of the third and fourth wing portions, said first and third wing portions, said second and fourth wing portions and said central portion collectively defining an opening therebetween, said opening having a central axis therethrough, said central axis bisecting said first and second wing end portions, a first distance existing from said opening central axis to a margin of said first wing portion, and a second distance existing from said opening central axis to a margin of said third wing portion, said second distance being in excess of said first distance so as to provide enhanced support of said third and fourth wing portions against deflection.

2. The invention claimed in claim 1 wherein said hanger generally has an I-beam cross-section.

3. The invention claimed in claim 2 wherein said first wing portion has a central planar part with bounding first and second flanges.

4. The invention claimed in claim 3 wherein said third wing portion has a central planar part, a bounding flange in continuity with said first wing portion second flange and a further bounding flange.

5. The invention claimed in claim 1 wherein said third and fourth wing portions defined undulating surfaces in bounding relation to said opening.

6. The invention claimed in claim 1 wherein said central portion defines a projection extending dependently therefrom into said continuous opening in confronting relation to said third and fourth wing portions.

7. The invention claimed in claim 6 wherein said projection is of thickness equal to the thickness of said central portion.

8. The invention claimed in claim 6 wherein said projection is of thickness approximately one-half of the thickness of said central portion.

* * * * *